United States Patent [19]

Takeda

[11] Patent Number: 4,627,540

[45] Date of Patent: Dec. 9, 1986

[54] AUTOMATIC MAIL PROCESSING APPARATUS

[75] Inventor: Kazuo Takeda, Kawasaki, Japan

[73] Assignee: Tokyo Shibaura Denki Kabushiki Kaisha, Kawasaki, Japan

[21] Appl. No.: 496,989

[22] Filed: May 23, 1983

[30] Foreign Application Priority Data

May 29, 1982 [JP] Japan ..... 57-91688
May 29, 1982 [JP] Japan ..... 57-91689

[51] Int. Cl.[4] ..... B07C 5/10

[52] U.S. Cl. ..... 209/555; 209/584; 209/586; 209/900; 100/4; 53/54; 53/504

[58] Field of Search ..... 100/4; 53/54, 504; 209/552, 563–566, 584, 586, 653, 555, 900

[56] References Cited

U.S. PATENT DOCUMENTS

| | | | |
|---|---|---|---|
| 2,917,884 | 12/1959 | Winkler et al. . | |
| 3,181,685 | 5/1965 | Brunner et al. | 198/372 |
| 3,409,129 | 11/1968 | Sperry | 209/563 X |
| 3,666,093 | 5/1972 | Thornton et al. | 209/586 |
| 3,782,541 | 1/1974 | Wood | 209/900 |
| 3,987,902 | 10/1976 | Burgess et al. | 209/586 X |
| 4,167,476 | 9/1979 | Jackson | 209/900 X |
| 4,468,165 | 8/1984 | Kawasaki | 209/900 X |
| 4,507,739 | 3/1985 | Hanki et al. | 209/900 X |

FOREIGN PATENT DOCUMENTS

| | | |
|---|---|---|
| 0066186 | 8/1982 | European Pat. Off. . |
| 2261520 | 6/1973 | Fed. Rep. of Germany . |
| 2711132 | 9/1978 | Fed. Rep. of Germany . |

*Primary Examiner*—Robert B. Reeves
*Assistant Examiner*—Glenn B. Foster
*Attorney, Agent, or Firm*—Cushman, Darby & Cushman

[57] ABSTRACT

In an automatic mail processing apparatus, a mail reject mechanism is disposed between a reading and sorting unit and labeling unit. The mail reject mechanism includes a reject member movable between a first position outside of a convey unit and a second position inside of the convey unit and a pneumatic cylinder for normally holding the reject member in the first position and being adapted, when the sorting data stored in a memory relating to a mail stack brought in an opposite position to the reject member is not appropriate to the mail stack, to move the reject member from the first position to the second position for removal of the mail stack from the convey unit.

5 Claims, 11 Drawing Figures

AUTOMATIC MAIL PROCESSING APPARATUS

BACKGROUND OF THE INVENTION

This invention relates to an automatic mail processing apparatus capable of performing sorting and piling, pick up, labeling, bundling and any other steps necessary for mail processing in an automatic sequence, and in particular, an automatic mail processing apparatus having reject means for rejecting defective mail.

Automatic mail processing apparatuses have recently been developed which incorporate a reading and sorting machine with automatic delivery, a labeling machine and a bundling machine coupled together by means of a transfer unit in an attempt to process a great amount of mail quickly and reliably with less manpower.

The reading and sorting machine reads out postal codes of the individual pieces of mail fed thereto, stores the read-out data in a memory, piles the mail in a selected one of more than one hundred sorting boxes and autmatically delivers mail from the sorting boxes to a transfer unit when a predetermined number of pieces are piled in one particular sorting box. The transfer unit transports the delivered pile of mail to a labeling apparatus, and then to a bundling apparatus. The labeling apparatus prints a bar code on a paper sheet to make a label, this bar code corresponding to sorting data (postal code, etc.) shifted in said memory in synchronism with the transportation of the mail pile, and attaches the label to the mail pile. The bundling apparatus bundles the labelled pile of mail with a crossing tape. The bundled mail is sorted by the bar codes printed on the attached labels and collected into the corresponding mailbags.

However, such conventional automatic mail processing apparatuses have the drawback that sorting data in the memory are likely to be lost by triboelectric noise generated by friction between contiguous pieces of mail in the pile while being transported from the sorting box to the labeling apparatus. If this happens, the labeling apparatus, and hence, the entire mail sorting system becomes inoperative, thus reducing the efficiency of the mail processing operation.

The bundling apparatus is required to impart a proper tension to a bundling tape so that a pile of mail is prevented from becoming unbound in the course of transportation in the bundling apparatus. On the other hand, such a bundling tape has the drawback that its tension may often be greater than the lateral strength of the mail pile, eventually rolling, or in extreme cases, breaking pieces of mail, even if the pile contains an excess number of pieces. To cope with this drawback, the number of pieces in a pile is counted at the time of sorting and the count data produced are stored in the memory together with the sorting data. When a pile of mail arriving at the bundling apparatus is determined on a basis of the count data in the memory to contain less than a determined number of pieces, that mail pile can be rejected from the conveying unit on the assumption that such a pile does not have satisfactory rigidity, so that damage by the bundling apparatus can be avoided. If the data are lost from the memory in the above-mentioned process, however, the count data are also lost, so that the number of pieces of mail cannot be determined, thus increasing the probability of damaging the mail in the bundling apparatus.

Further, even if the count data are maintained in the memory, the bundling apparatus cannot avoid the following drawback. Comparing piles of 10 postcards and 10 5 mm-thick letters, the latter has a greater rigidity than the former. When the above-mentioned threshold number is set on the basis of a less-rigid mail pile, there is the possibility that a pile having less than the predetermined threshold number of pieces, but having a good rigidity for bundling may be rejected, thus reducing the efficiency of the mail processing operation.

SUMMARY OF THE INVENTION

This invention was made in view of these problems, and the object thereof is to provide an automatic mail processing apparatus having an improved operating efficiency.

According to one aspect of the invention there is provided an automatic mail processing apparatus comprising: reading and sorting means adapted to read out mail sorting data, forming mail stacks in accordance with said sorting data, and automatically removing the stacks of mail successively, including a memory for storing said read-out sorting data; convey means for transporting along one direction stacks of mail removed from said reading and sorting means; labeling means provided on said convey means downstream of the reading and sorting means along said one direction, for attaching a label bearing the corresponding sorting data to a stack of mail transported by said convey means from said reading and sorting means, said corresponding sorting data being derived from said memory in said reading and sorting means; bundling means provided on said convey means downstream of said labeling means, for bundling a mail stack having said label attached thereto by said labeling means; and mail reject means disposed between said reading and sorting means and said labeling means and including a reject member movable between a first position outside of said convey means and a second position inside of said convey means, and actuation means for normally holding said reject member in said first position and being adapted, when the sorting data stored in said memory relating to a mail stack brought in an opposite position to said reject member is not appropriate to the mail stack, to move said reject member from said first position to said second position for removal of said mail stack from said convey means.

According to another aspect of the invention there is provided an automatic mail processing apparatus comprising: reading and sorting means adapted to read out mail sorting data, forming mail stacks in accordance with said sorting data, and automatically removing the stacks of mail successively; convey means for transporting along one direction stacks of mail removed from said reading and sorting means; labeling means provided on said convey means downstream of the reading and sorting means along said one direction, for attaching a label bearing the corresponding sorting data to a stack of mail transported by said convey means from said reading and sorting means; bundling means provided on said convey means downstream of said labeling means, for bundling a mail stack having said label attached thereto by said labeling means; detection means disposed between said labeling means and said bundling means for detecting a thickness of a mail stack transported by said convey means; and mail reject means disposed between said detection means and said bundling means and including a reject member movable between a first position outside of said convey means and a second position inside of said convey means, and actuation means for normally holding said reject member in said first position and being adapted, when said detection means detects a thickness of mail stack brought to a position opposite said reject member, which is insufficient to prevent damage by the bundling action, to move said reject member from said first position to the second position for removal of said mail stack from said convey means.

DETAILED DESCRIPTION OF THE PREFERRED EMBODIMENT

One embodiment according to this invention will be described with reference to the accompanying drawings.

Figure 1:
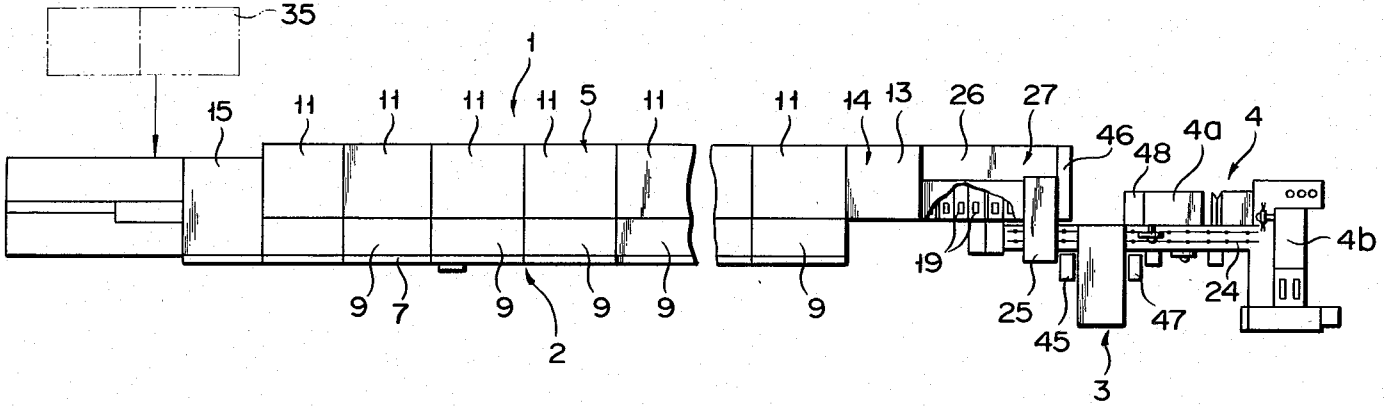
FIGS. 1 and 2 are plane and front views, respectively, schematically showing one embodiment of an automatic mail processing apparatus according to the invention.
Figure 2:
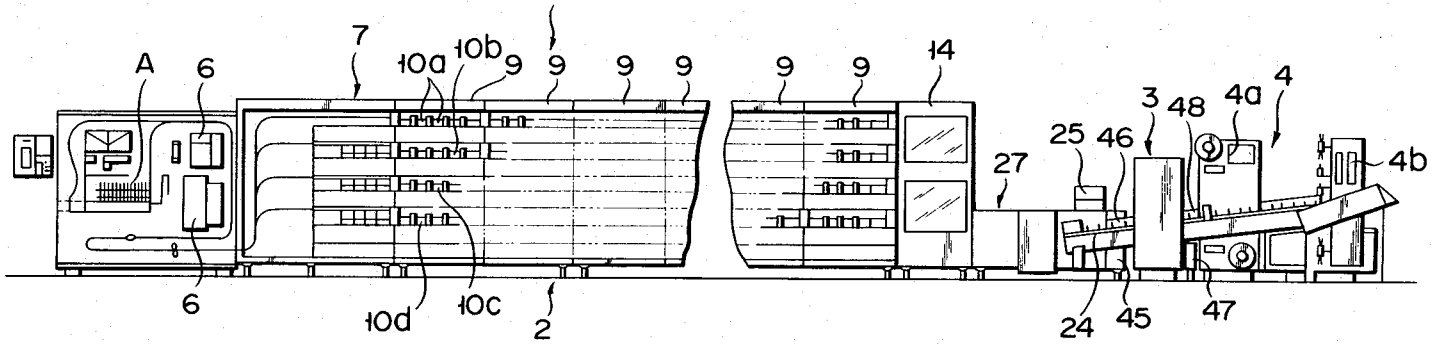
Figure 3:
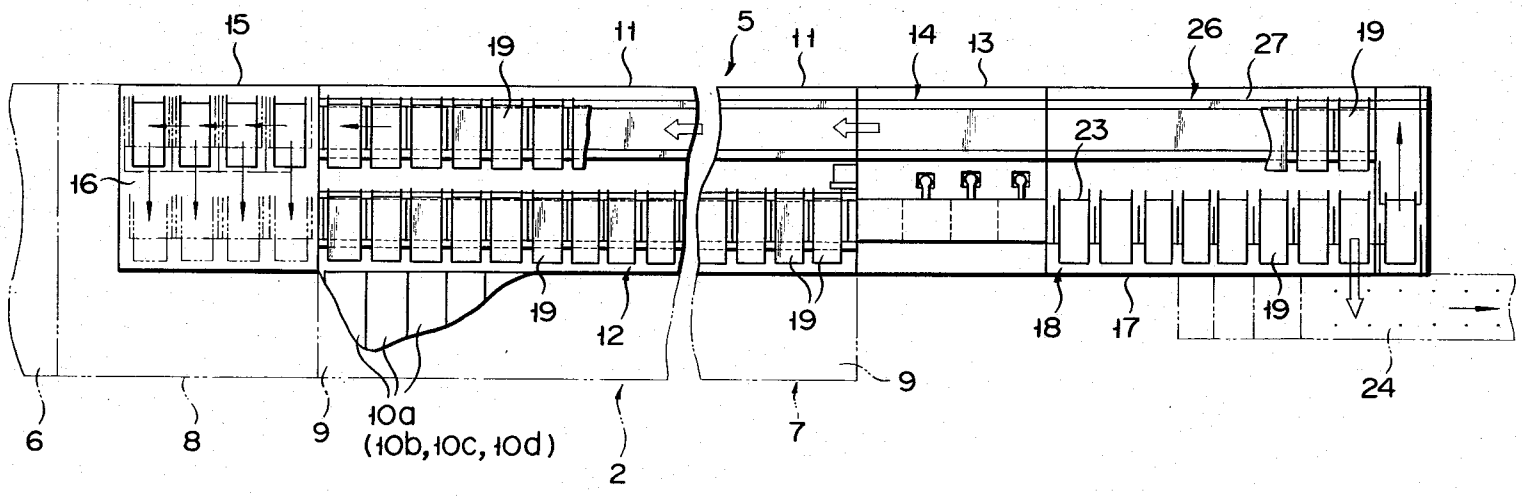
FIGS. 3 and 4 are plane and front views, respectively, schematically showing a convey unit incorporated in the automatic mail processing apparatus.
Figure 4:
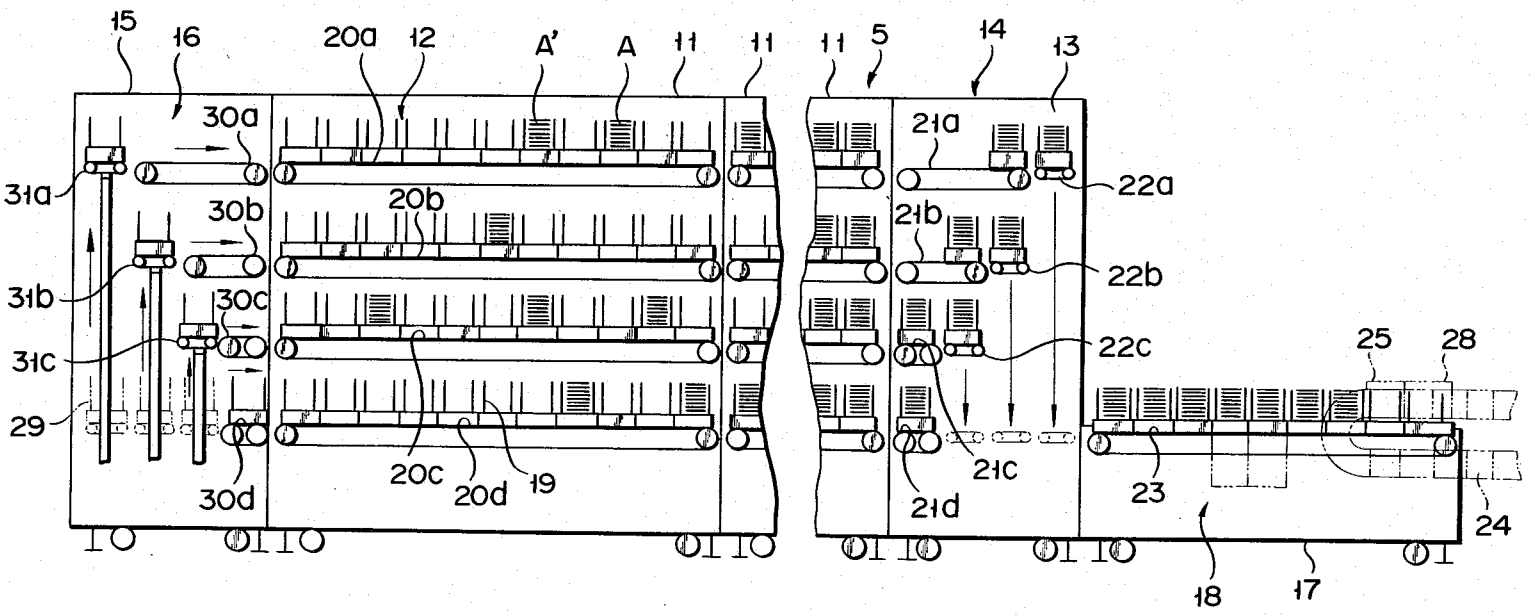
Figure 5:
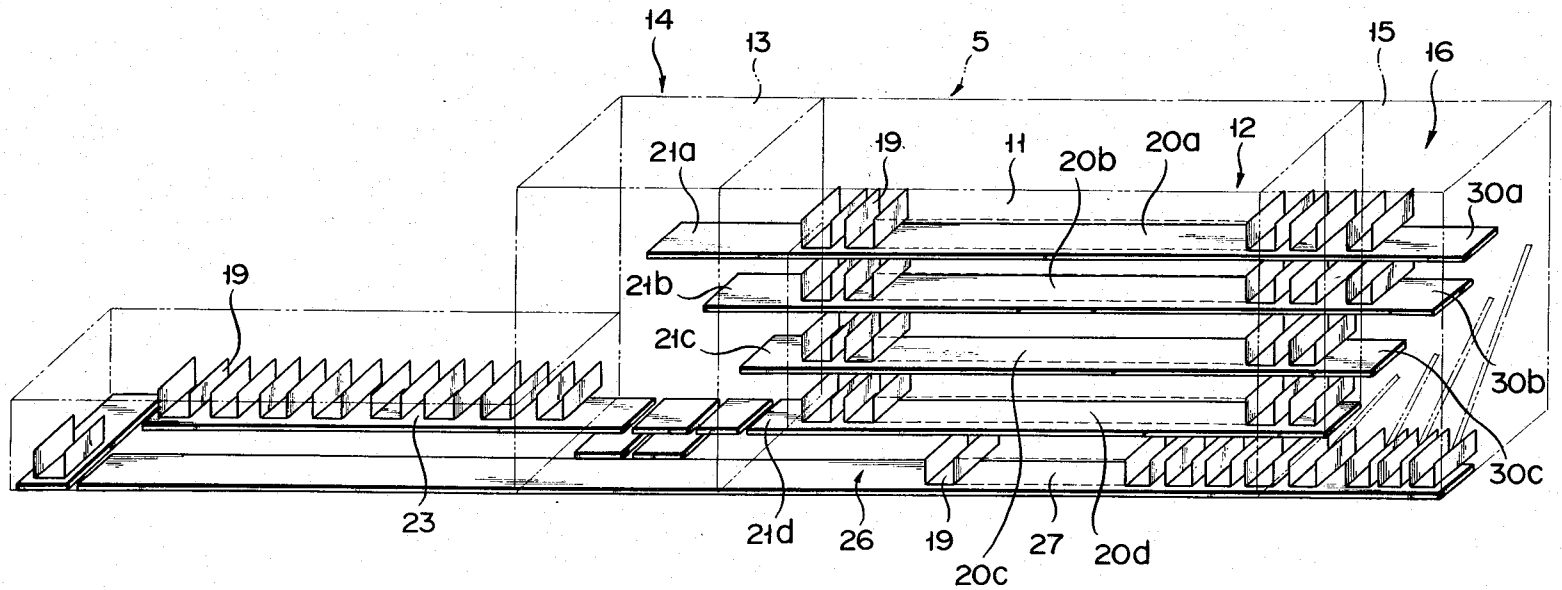
FIG. 5 is a perspective view schematically showing the rear side of the convey unit of FIGS. 3 and 4.

As depicted in FIGS. 1 and 2, an automatic mail processing apparatus 1 embodied by the invention has, generally, a reading and sorting unit 2 with automatic removal function for sorting mail and making stacks of mail, a labeling unit 3, bundling unit 4, and convey unit 5 for transporting stacks of mail through the labeling unit 3 to the bundling unit 4.

The reading and sorting unit 2 has a reader section 6 for reading out postal codes, or sorting data or information, of the individual pieces of mail A, a sorter section 7 for sorting and stacking mail A in accordance with the sorting data, and an auxiliary stacking section 8 for stacking mail having data which is unreadable by the reader section 6.

The sorter section 7 comprises a plurality of sorter units 9 connected in a horizontal row and each having a plurality of stacking boxes 10*a*, 10*b*, 10*c* and 10*d* vertically arranged in four rows. Each box is provided with a pusher device (not shown) for automatically pushing mail stacks A to the rear side of the sorter section 7 when a proper number of pieces have been received in the boxes.

The aforementioned convey unit 5 is located along the sorter section 7 for transporting sorted and stacked mail A from each of the boxes of the sorter section 7 to a subsequent station, and has a first convey section 12 comprising a plurality of transverse feeder units 11 correspondingly located in the rear side of each of the sorter units 9, a collecting section 14 accommodated in a descending lifter unit 13 which is connected to the one end of the transverse feeder units 11, a distributing section 16 accommodated in an ascending lifter unit 15 connected to the other end of the transverse feeder unit 11, and a second convey section 18 accommodated in a mail transfer unit 17 which is connected to the descending lifter unit 13.

The convey unit 5 has a plurality of trays 19 for receiving mail stacks A pushed out from the respective boxes 10*a*, 10*b*, 10*c* and 10*d* of corresponding sorter units 9. Each tray is intermittently carried horizontally in opposition to the contiguous stacking boxes 10*a*, 10*b*, 10*c* and 10*d* through horizontal tray convey paths 20*a*, 20*b*, 20*c* and 20*d*.

The collecting section 14 operates to receive and collect trays 19 delivered by the horizontal tray convey paths 20*a*, 20*b*, 20*c* and 20*d*. Provided in the collecting section 14 are a first, second, third and fourth collection intermediary paths 21*a*, 21*b*, 21*c* and 21*d* adjacent the terminal ends of the tray horizontal convey paths 20*a* 20*b*, 20*c* and 20*d*, respectively, and first, second and third descending elevators 22*a*, 22*b* and 22*c*, adapted to lower the trays 19 from the first, second, and third collection intermediary paths 21*a*, 21*b* and 21*c* all to the same level as the fourth collection intermediary path 21*d* so that they and trays from the fourth collection intermediary path 21*d* can be fed together onto the aforementioned second convey section 18.

The second convey section 18 has a collected tray convey path 23 for horizontally carrying trays 19 collected in the collection section 14. At the terminal end of the collected tray convey path 23 there is provided a mail transfer apparatus 25 for transferring mail stacks to a bundling pin line 24 along which a labeling unit 3 and a bundling unit 4 are disposed. Additionally, an empty tray transfer apparatus 28 is disposed at the terminal end of the collection convey path 23 for transferring to an empty tray convey path 27 in a third convey unit 26 (to be described later) trays from which mail has been transferred by the mail transfer apparatus.

The empty tray convey path 27 is directed to return empty trays to the starting ends of the horizontal tray convey paths 20*a*, 20*b*, 20*c* and 20*d* and, for this reason, has a second empty tray transfer apparatus 29 at the terminal end of the empty tray convey path 27 for transferring empty trays from the latter to the distributing section 16.

The distributing section 16 is directed to supply to the starting ends of the aforementioned tray horizontal convey paths 20*a*, 20*b*, 20*c* and 20*d* empty trays returned by the third convey unit 26. To this end, it has first, second, third and fourth distribution intermediary paths 30*a*, 30*b*, 30*c* and 30*d* disposed correspondingly to the starting ends of the respective tray horizontal convey paths 20*a*, 20*b*, 20*c* and 20*d*, and first second and third ascending elevators 31*a*, 31*b* and 31*c* for receiving trays transferred by the second empty tray transfer apparatus 24 and supplying the same to the first, second and third distribution transfer paths 30*a*, 30*b* and 30*c* and to the fourth distribution transfer path 30*d*.

The first, the second and the third convey sections 12, 18 and 26, and the ascending and descending elevators 31*a*, 31*b*, 31*c*, 22*a*, 22*b* and 22*c* all include an endless convey belt for transversely feeding trays 19, a stopper device 32 (FIG. 6) for sliding trays onto determined portions on the convey belts, and transportation detector 33 (FIG. 8) for detecting the position of each tray 19.

Figure 6:
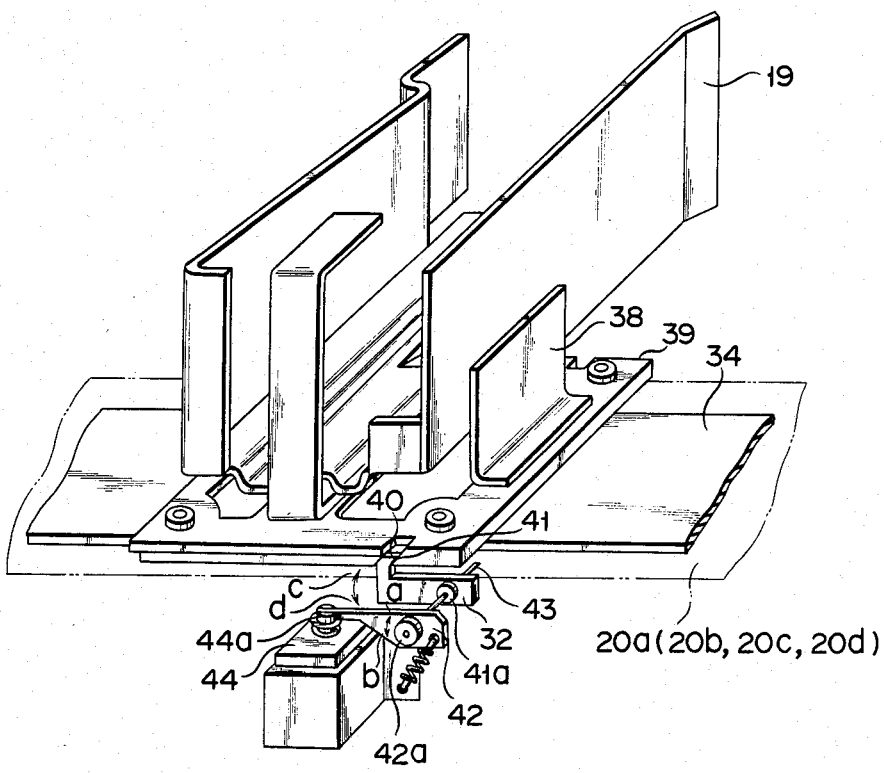
FIG. 6 is a perspective view showing a pallet with a top device incorporated in the convey unit.
Figure 7:
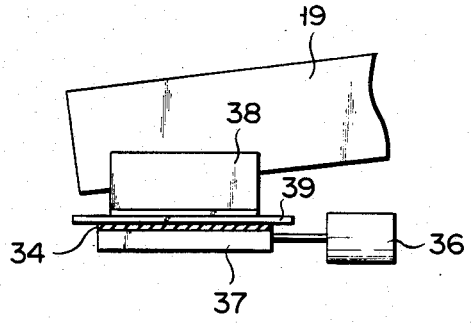
FIG. 7 is a side view showing a pallet with a drive device.
Figure 8:
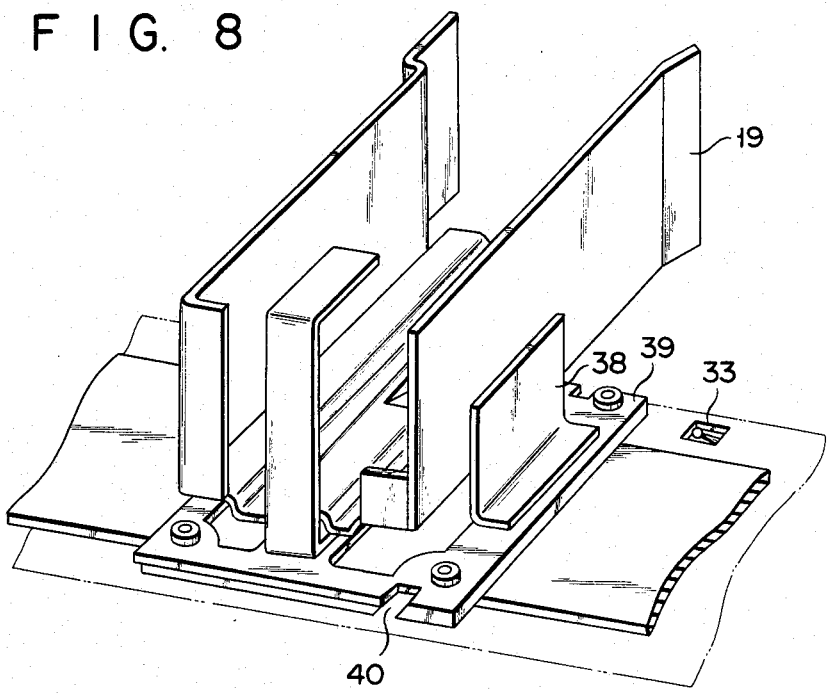
FIG. 8 is a perspective view showing a pallet with a transportation detector.

Trays are carried on an endless belt 34 as shown in FIGS. 6 to 8. The belt engages and is driven by a rotary roller 37 rotated in response to an electric motor 36 controlled by a microcomputer 35 for the reading and sorting unit 2. A bottom plate 39 is placed on the surface of the belt. The tray 19 is secured to the bottom plate 39 by means of an L-shaped bracket 38. The bottom plate 39 has a cutout 40 in which a projection 41 of the stopper device 32 is engaged to stop the bottom plate, and accordingly, the tray 19. The projection 41 of the stopper device 32 has a pivot 41*a*. The stopper device 32 has an actuator plate 42 with a pivot 42*a* at one end rigidly connected to the pivot 41*a* of the projection 41 by a shaft 43. A solenoid 44 has a plunger pin 44*a* which is connected to the other end of the shaft 43, whereby reciprocating movement of the plunger pin causes the actuator plate to pivot in the directions of arrows a and b, thereby pivoting the projection 41 in the directions c and d.

The transportation detector 33 may be disposed, for example, in the stopper device 32 on the horizontal tray convey paths 20*a*, 20*b*, 20*c* and 20*d*, as can be seen in FIG. 8 wherein the stopper device is constituted by a microswitch capable of being turned on by engagement with the bottom plate 31 of the tray 19 carried by the convey belt 34.

In operation, when a proper number of pieces of mail have been stacked in any of the stacking boxes 10*a*, 10*b*, 10*c* and 10*d* of the sorter section 7, the automatic pusher device operates to push mail to the rearside and to transfer the same to empty trays 19 in the tray horizontal convey paths 20*a*, 20*b*, 20*c* and 20*d* disposed corresponding to the stacking boxes.

Trays on the tray horizontal convey paths 20*a*, 20*b*, 20*c* and 20*d* are moved intermittently to arrive successively at positions opposed to the contiguous stacking boxes. Trays at the terminal ends thereof are transferred to collection intermediary convey paths 21*a*, 21*b*, 21*c* and 21*d* in the collection section 14. Trays on the collection intermediary convey paths 21*a*, 21*b* and 21*c* are individually transferred to the respective descending elevators 22*a*, 22*b* and 22*c* and lowered thereby to the same height as trays on the collection intermediary path 21*d*. All the trays are then fed to the common collected tray convey path 23.

Mail in the trays 19 fed to collected tray convey path 23 is transferred by the mail transfer apparatus 25 to the bundling pin line 24 which transfers mail A intermittently. Trays 19 which are emptied by the transfer of mail are transferred by the first empty tray transfer apparatus 28 to the empty tray convey path 27 for return to the starting ends of the tray horizontal convey paths 20*a*, 20*b*, 20*c* and 20*d*.

Empty trays 19 returned are transferred by the second empty tray transfer apparatus 29 to the ascending elevators 31*a*, 31*b* and 31*c*, and to the distribution intermediary convey path 30*d*. Trays transferred onto the ascending elevators 31*a*, 31*b* and 31*c* are further transferred by the ascending movement of the elevators to distribution intermediary convey paths 30*a*, 30*b* and 30*c*. Trays on distribution intermediary convey paths 30*a*, 30*b*, 30*c* and 30*d* are fed to the starting ends of the tray horizontal convey paths 20*a*, 20*b*, 20*c* and 20*d*, respectively.

As stated in the foregoing, the labeling unit 3 and the bundling unit 4 are disposed along the bundling pin line in the direction of transport. The labeing unit 3 prints bar codes on a paper sheet as well as the names of the destination post office relating to the particular mail stack arriving there on the pin line 24, and attaches the printed sheet to that mail stack. Mail stacks with the label attached thereto proceed further along the pin line to arrive at the bundling unit 4 which comprises transverse and longitudinal bundling sections 4*a* and 4*b*. The transverse bundling sections 4*a* tapes the individual mail stack in one direction and then the longitudinal bundling section 4*b* tapes it in the other direction, so that the mail stack is bundled with crossing tapes.

A first reject device 46 is provided on the bundling pin line 24 contiguous with and upwards of the labeling unit 3 in the direction of transporation, for rejecting from the bundling pin line and into a stacking box 45 any mail stacks which have data which was lost in the course of transportation or have stored data which has been determined to be incorrect by parity checking (i.e., having inappropriate data stored in the memory). Further, a second reject device 48 is provided between the labeling unit 3 and the transverse bundling section 4*a* of bundling unit 4 on the bundling pin line 24, for rejecting from the bundling pin line 24 into a stacking box 47 any mail stack smaller than a specified height.

Figure 9:
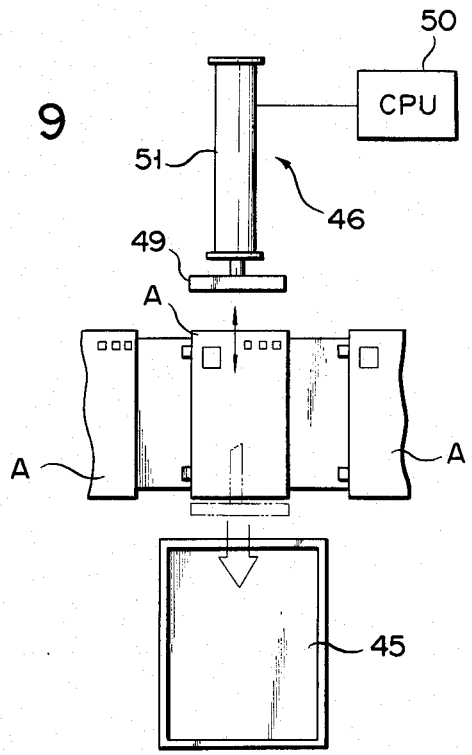
FIG. 9 is a topside view showing a reject device.

The first reject device 46 is disposed, as depicted in FIG. 9, in opposition to a position where a pile of mail temporarily rests in the course of transportation with intermittent movement, and has a first reject member 49 movable between the outside and inside of the convey path of the bundling pin line 24, and a pneumatic cylinder 51 adapted to normally maintain the first reject member 49 outside of the convey path of the bundling pin line 24, and to receive a command signal from the CPU 50 for the labeling unit 3 to function as an actuation means for moving the reject member 49 inside of that convey path. Thus, in case the data have been lost from the memory or incorrect data are found therein by a parity check of an intermittently transported mail stack arriving at the position opposite to the first reject device 46, the pneumatic cylinder 51 is activated by a command from CPU 50 to move the reject member 49 from the outside to the inside of the convey path, thereby pushing the mail stack off the bundling pin line 24 into a receiving box 45. If data of a mail stack has not been lost or was not found to be erroneous by a parity check, the absence of a command from the CPU keeps the pneumatic cylinder 51 inactivated, thus allowing the mail stack to proceed without being rejected to the labeling unit 3 whereby a label with a bar code indicative of the postal code and the name of the destination post office printed thereon is attached to the mail pile.

Figure 10:
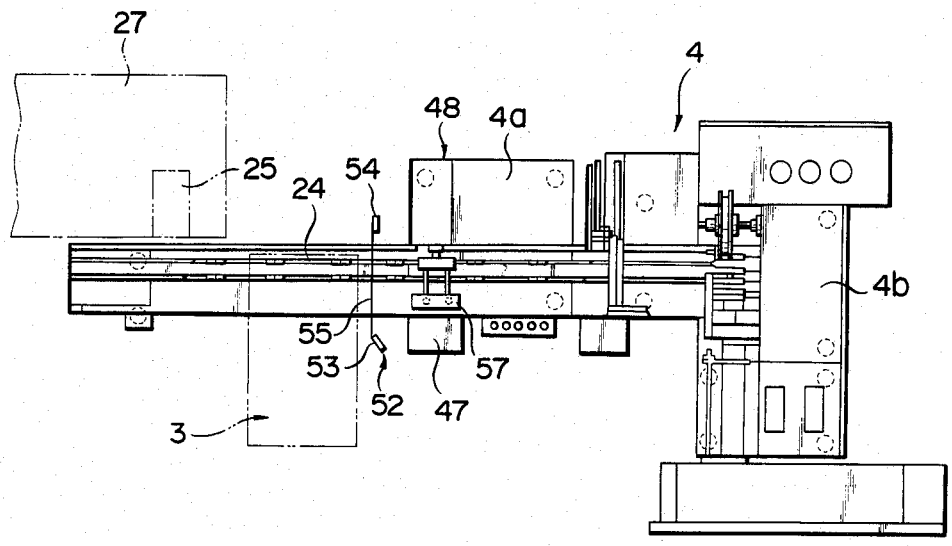
FIG. 10 is a topside view showing a bundler pin line.
Figure 11:
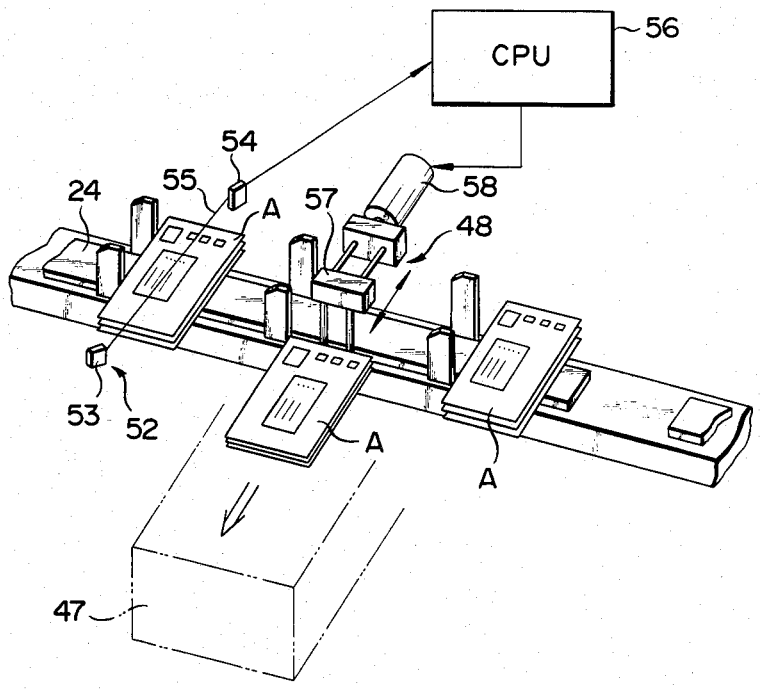
FIG. 11 is a perspective view showing a second reject device.

An optical detector 52 for detecting the thickness of stacks of mails is, as shown in FIGS. 10 and 11, disposed between the aforementioned second reject device 48 and the labeling unit 3, and has a light emitter 53 and receptor 54 in optical alignment with each other with a light beam 54 therebetween transversing the bundling pin line 24, and positioned at a height equivalent to a thickness of mail stacks sufficient to resist the tension of the bundling operation and so not become undesirably rolled or damaged by the tension. If a transported mail stack is tall enought to interrupt the light beam, the CPU 56 of the bundling unit 4 decides that the mail pile can be appropriately bundled. If a transported stack does not interrupt the light beam but allows the light receptor to receive the light from the emitter, the CPU 56 decides that such a mail stack is likely to be damaged or rolled during the bundling operation.

The second reject device 48 has an arrangement similar to the first reject device 46, with a second reject member 57 and a second pneumatic cylinder 58. The second pneumatic cylinder 58 remains unactivated by the CPU 56 of the bundling unit 4 when the light beam of the optical thickness detector is intercepted by a mail stack, so that the mail stack with a label attached thereto proceeds on to the bundling unit 4 via the bundling pin line. If a mail stack does not intercept the light beam, on the other hand, the CPU 56 decides that this stack, while having a label attached thereto and a greater number of pieces than a predetermined threshold number, is not sufficiently thick to withstand bundling, and so activates the second pneumatic cylinder 58 to cause the reject member to reject the stack from the convey path into a receiving box 47.

Thus, only mail stacks actually thicker than a predetermined value, so as to present a good rigidity and resistance to the bundling tension, are transported, which prevents the bundling process from undesirably rolling and damaging stacks of mail which are too weak to have a good rigidness although more than a determined threshold number of mails are contained and yet avoids rejection of mail piles which are sufficiently strong to permit bundling.

It is to be understood from the foregoing description that in the event the labeling unit fails to operate, this invention will permit mail stacks not having labels attached thereto to be rejected without interrupting the mail operation, thus enhancing the efficiency of the operation. In the event that any mail stacks are sent to the automatic processing apparatus which are judged likely to be rolled or damaged during the bundling operation, the invention permits such stacks to be rejected without interruption of the mail operation to further enhance the efficiency of the operation.

What is claimed is:

1. An automatic mail processing apparatus comprising:

reading and sorting means for (i) reading out mail sorting data, (ii) forming mail stacks in accordance with said sorting data, and (iii) automatically and successively removing the mail stacks;

convey means for transporting, along one direction, a stack of mail removed from said reading and sorting means;

labeling means, provided on said convey means downstream of the reading and sorting means along said one direction, for attaching a label bearing the corresponding sorting data to a stack of mail transported by said convey means from said reading and sorting means;

bundling means provided on said convey means downstream of said labeling means, for bundling a mail stack having said label attached thereto by said labeling means;

detection means disposed between said labeling means and said bundling means for detecting a thickness of a mail stack transported by said convey means; and mail reject means disposed between said detection means and bundling means and including (a) a reject member movable between a first inoperative position relative to said convey means and a second operative position relative to said convey means, and (b) actuation means for normally holding said reject member in first inoperative position and for moving said reject member from said first inoperative position to said second operative position to thereby remove said mail stack from said convey means in response to said detection means detecting a thickness of said mail stack less than a predetermined thickness which is sufficient to prevent damage by said bundling means;

said detection means including a light source and light receptor means for receiving light from said light source, said light source and said light receptor means establishing therebetween a light path which tranverse said convey means, and wherein said light source and said light receptor means are placed at a height corresponding to said predetermined thickness of a mail stack whose rigidness inhibits the bundling action from damaging the mail stack.

2. The automatic mail processing apparatus according to claim 1, wherein said mail reject means includes a box for receiving said mail stack removed from said convey means by said reject member.

3. The automatic mail processing apparatus according to claim 1, wherein said actuation means includes means to move said reject member in a direction normal to said one direction of transportation of mail stacks by said convey means.

4. The automatic mail processing apparatus according to claim 3, wherein said means to move said reject member includes a penumatic cylinder.

5. The automatic mail processing apparatus according to claim 1, wherein said light source is a light-emitting diode.

* * * * *